US008414112B2

(12) United States Patent
Pan et al.

(10) Patent No.: US 8,414,112 B2
(45) Date of Patent: Apr. 9, 2013

(54) HIGH SPEED PRINTING MATERIAL DELIVERY SYSTEM

(75) Inventors: Wei Ming Pan, Teresa Ville (SG); Hin Loong Wong, Clementi (SG)

(73) Assignee: Dell Products L.P., Round Rock, TX (US)

( * ) Notice: Subject to any disclaimer, the term of this patent is extended or adjusted under 35 U.S.C. 154(b) by 437 days.

(21) Appl. No.: 12/553,468

(22) Filed: Sep. 3, 2009

(65) Prior Publication Data

US 2011/0050813 A1 Mar. 3, 2011

(51) Int. Cl.
*B41J 29/38* (2006.01)
*B41J 2/175* (2006.01)

(52) U.S. Cl.
USPC ..... 347/85; 347/17

(58) Field of Classification Search ..... 347/84, 347/85, 86, 17
See application file for complete search history.

(56) References Cited

U.S. PATENT DOCUMENTS

| | | | | |
|---|---|---|---|---|
| 6,481,837 | B1 | 11/2002 | Askren et al. | |
| 6,742,861 | B2 | 6/2004 | McCarty | |
| 6,866,370 | B2 | 3/2005 | Jeanmaire | |
| 7,182,443 | B2 | 2/2007 | Salim et al. | |
| 7,331,664 | B2 | 2/2008 | Langford et al. | |
| 7,841,706 | B2 * | 11/2010 | Ishinaga et al. | 347/85 |
| 2005/0248634 | A1 * | 11/2005 | Aruga | 347/85 |
| 2010/0020140 | A1 * | 1/2010 | Yokouchi | 347/85 |

* cited by examiner

*Primary Examiner* — Jannelle M Lebron
(74) *Attorney, Agent, or Firm* — Haynes and Boone, LLP

(57) ABSTRACT

A printing material delivery system includes a printing material storage that includes a printing material. The printing material deliver system also includes a print head. A pressurizing device defines a housing that includes an inlet coupled to the printing material storage, an outlet coupled to the print head, and that houses a rotatable member that is operable to rotate and create a pressure differential in order to transfer the printing material from the printing material storage, through the pressurizing device, and out of the print head.

20 Claims, 9 Drawing Sheets

HIGH SPEED PRINTING MATERIAL DELIVERY SYSTEM

BACKGROUND

The present disclosure relates generally to information handling systems, and more particularly to a high speed printing material delivery system for a printer coupled to an information handling system.

As the value and use of information continues to increase, individuals and businesses seek additional ways to process and store information. One option is an information handling system (IHS). An IHS generally processes, compiles, stores, and/or communicates information or data for business, personal, or other purposes. Because technology and information handling needs and requirements may vary between different applications, IHSs may also vary regarding what information is handled, how the information is handled, how much information is processed, stored, or communicated, and how quickly and efficiently the information may be processed, stored, or communicated. The variations in IHSs allow for IHSs to be general or configured for a specific user or specific use such as financial transaction processing, airline reservations, enterprise data storage, or global communications. In addition, IHSs may include a variety of hardware and software components that may be configured to process, store, and communicate information and may include one or more computer systems, data storage systems, and networking systems.

Many IHSs include a printer coupled to the IHS for printing documents, photographs, transparencies, and/or a variety of other printed media known in the art. As the desired printing speed increases for printers such as, for example, inkjet printers, a number of issues arise. For example, the printing mechanism in inkjet printers generally includes a positive pressure (relative to the ambient outside the printing mechanism) from the printing material storage to the firing chambers of the print head nozzles in order to deliver a printing material (e.g., Ink) from the printing material storage to the printing media. Solutions to provide this positive pressure includes pre-pressurizing the printing material storage during its manufacture, or the use of a pump to pressurize the printing material storage after its manufacture and prior to printing activities. While these solutions are sufficient for the current level of desired inkjet printer speeds (e.g., 30 to 50 pages per minute (ppm)), such solutions are inefficient or inadequate for very high speeds (e.g., 100 ppm.)

Accordingly, it would be desirable to provide an improved high speed printing material delivery system (PMDS).

SUMMARY

According to one embodiment, a PMDS includes a printing material storage that includes a printing material, a print head, and a pressurizing device defining a housing that includes an inlet coupled to the printing material storage, an outlet coupled to the print head, and that houses a rotatable member that is operable to rotate and create a pressure differential in order to transfer the printing material from the printing material storage, through the pressurizing device, and out of the print head.

DETAILED DESCRIPTION

For purposes of this disclosure, an IHS may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, entertainment, or other purposes. For example, an IHS may be a personal computer, a PDA, a consumer electronic device, a network server or storage device, a switch router or other network communication device, or any other suitable device and may vary in size, shape, performance, functionality, and price. The IHS may include memory, one or more processing resources such as a central processing unit (CPU) or hardware or software control logic. Additional components of the IHS may include one or more storage devices, one or more communications ports for communicating with external devices as well as various input and output (I/O) devices, such as a keyboard, a mouse, and a video display. The IHS may also include one or more buses operable to transmit communications between the various hardware components.

Figure 1:
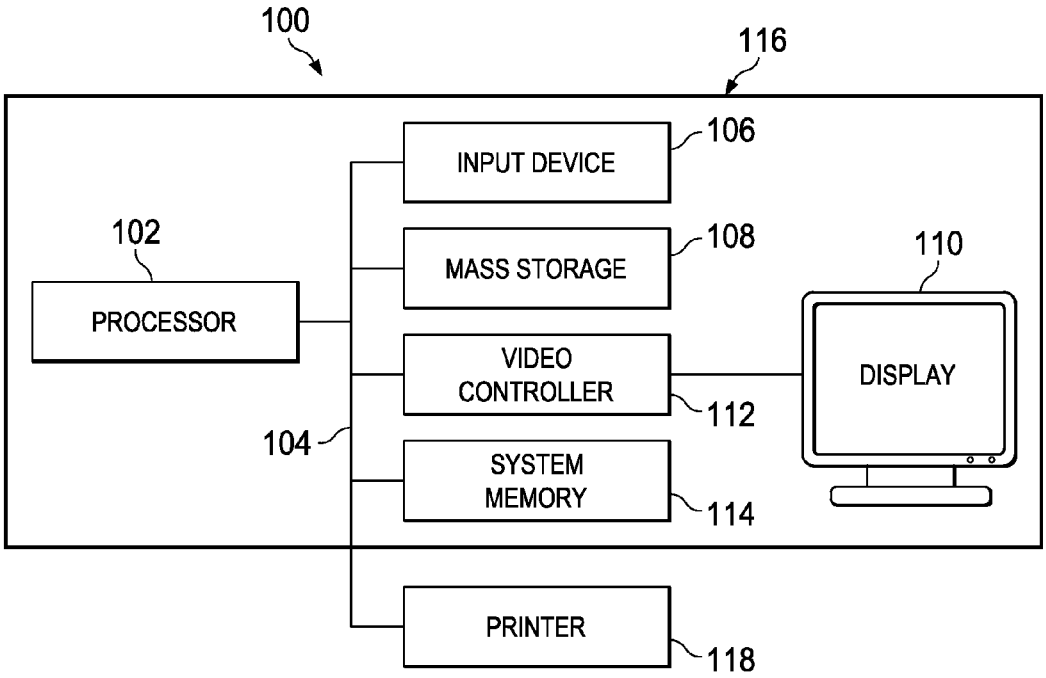
FIG. 1 is a schematic view illustrating an embodiment of an IHS.

In one embodiment, IHS 100, FIG. 1, includes a processor 102, which is connected to a bus 104. Bus 104 serves as a connection between processor 102 and other components of IHS 100. An input device 106 is coupled to processor 102 to provide input to processor 102. Examples of input devices may include keyboards, touchscreens, pointing devices such as mouses, trackballs and trackpads, and/or a variety of other input devices known in the art. Programs and data are stored on a mass storage device 108, which is coupled to processor 102. Examples of mass storage devices may include hard discs, optical disks, magneto-optical discs, solid-state storage devices, and/or a variety other mass storage devices known in the art. IHS 100 further includes a display 110, which is coupled to processor 102 by a video controller 112. A system memory 114 is coupled to processor 102 to provide the processor with fast storage to facilitate execution of computer programs by processor 102. Examples of system memory may include random access memory (RAM) devices such as dynamic RAM (DRAM), synchronous DRAM (SDRAM), solid state memory devices, and/or a variety of other memory devices known in the art. In an embodiment, a chassis 116 houses some or all of the components of IHS 100. A printer 118 is coupled to the processor 102 to allow the printing to various types of print media known in the art from the IHS 100. In an embodiment, the printer 118 is an inkjet printer. In an embodiment, the printer 118 includes an off-axis ink supply. It should be understood that other buses and intermediate circuits can be deployed between the components described above and processor 102 to facilitate interconnection between the components and the processor 102.

Figure 2A:
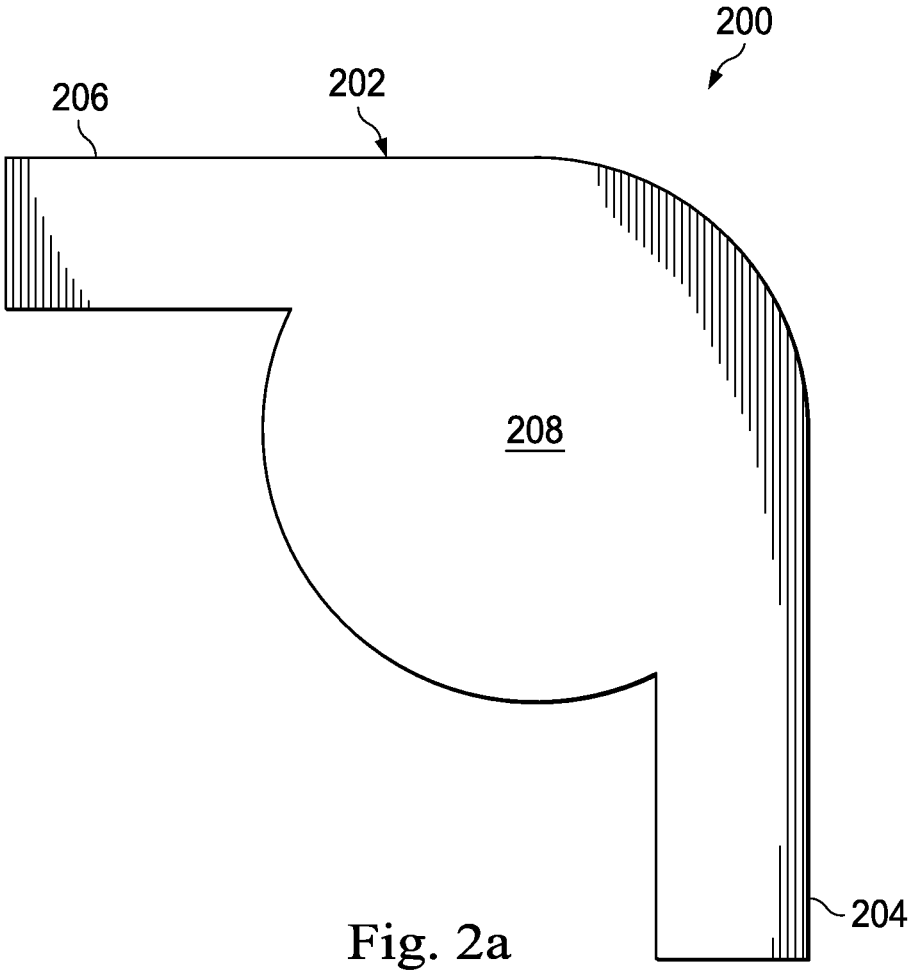
FIG. 2*a* is a side view illustrating an embodiment of a pressurizing device.
Figure 2B:
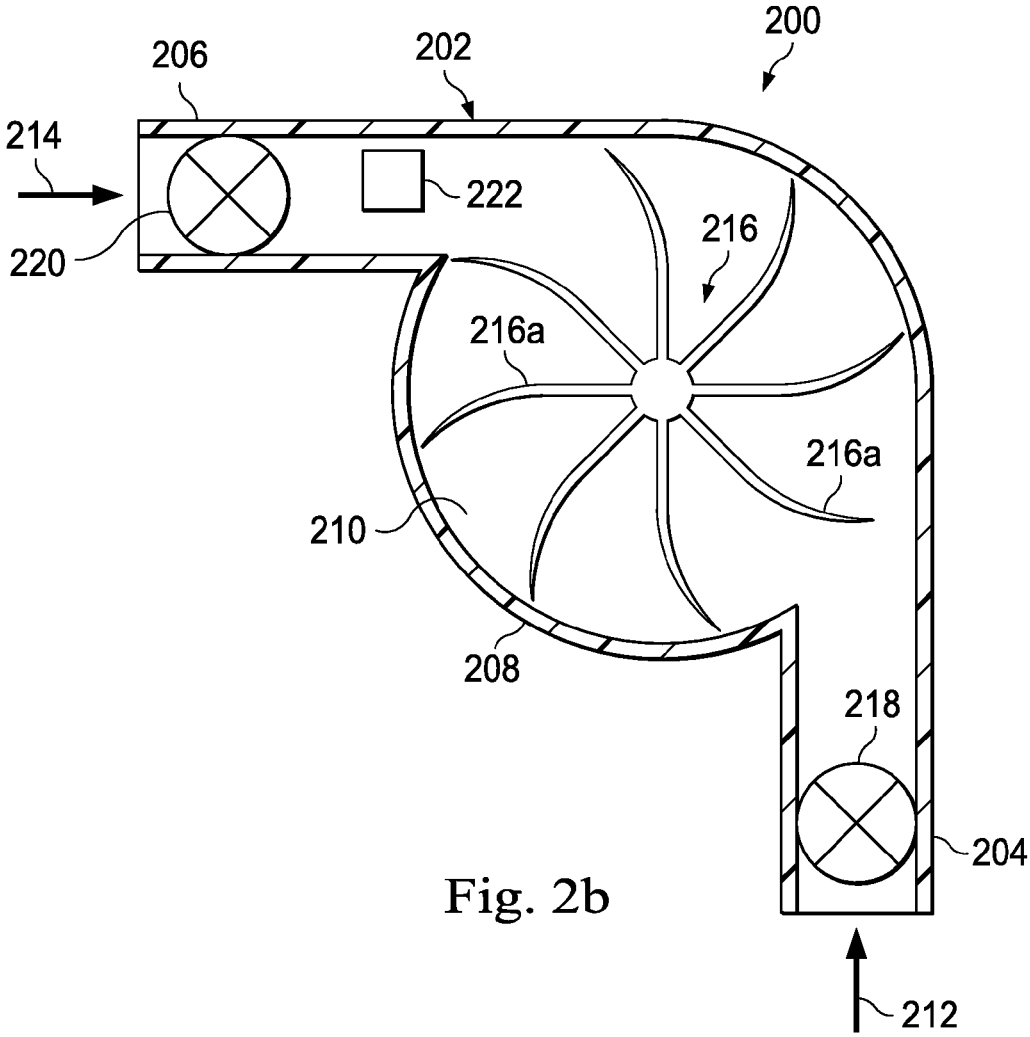
FIG. 2*b* is a cross-sectional side view illustrating an embodiment of the pressurizing device of FIG. 2*a*.
Figure 2C:
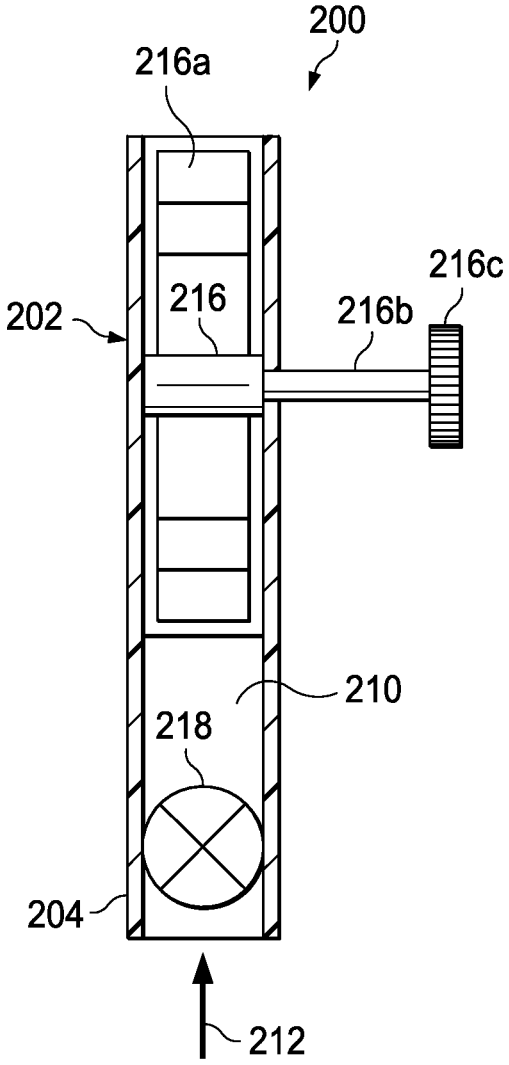
FIG. 2*c* is a cross-sectional rear view illustrating an embodiment of the pressurizing device of FIGS. 2*a* and 2*b*.

Referring now to FIGS. 2*a*, 2*b* and 2*c*, a pressurizing device 200 is illustrated. In an embodiment, the pressurizing device 200 may be located in the printer 118, described above with reference to FIG. 1, as will be described in further detail below. The pressurizing device 200 includes a base 202 having a storage coupling section 204, a print head coupling section 206, and a rotatable member section 208 located between the storage coupling section 204 and the print head coupling section 206. The storage coupling section 204, print head coupling section 206, and rotatable member section 208 define a housing 210 that is surrounded by the base 202 and that extends through the base 202 from an inlet 212 that is located on a distal end of the storage coupling section 204 to an outlet 214 that located on a distal end of the print head coupling section 206. A rotatable member 216 is located in the housing 210 adjacent the rotatable member section 208, rotatably coupled to the base 202, and includes a plurality of rotatable member blades 216*a*. A shaft 216*b* extends from the rotatable member 216 and includes a gear 216*c* on its distal end. A check valve 218 is located in the housing 210 adjacent the storage coupling section 204 and between the inlet 212 and the rotatable member 216. A release valve 220 is located in the housing 210 adjacent the print head coupling section 206 and between the outlet 214 and the rotatable member 216. A pressure monitor 222 is located in the housing 210 between the rotatable member 216 and the outlet 214. However, in another embodiment, the pressure monitor 222 may be positioned at different locations within the housing 210. In an embodiment, the pressure monitor 222 may be coupled to the processor 102, described above with reference tot FIG. 1.

Figure 3A:
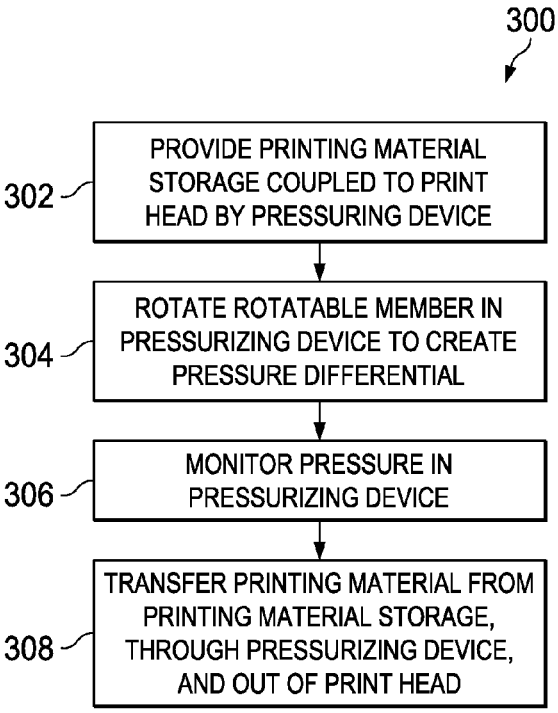
FIG. 3*a* is a flow chart illustrating an embodiment of a method for delivering a printing material.
Figure 3B:
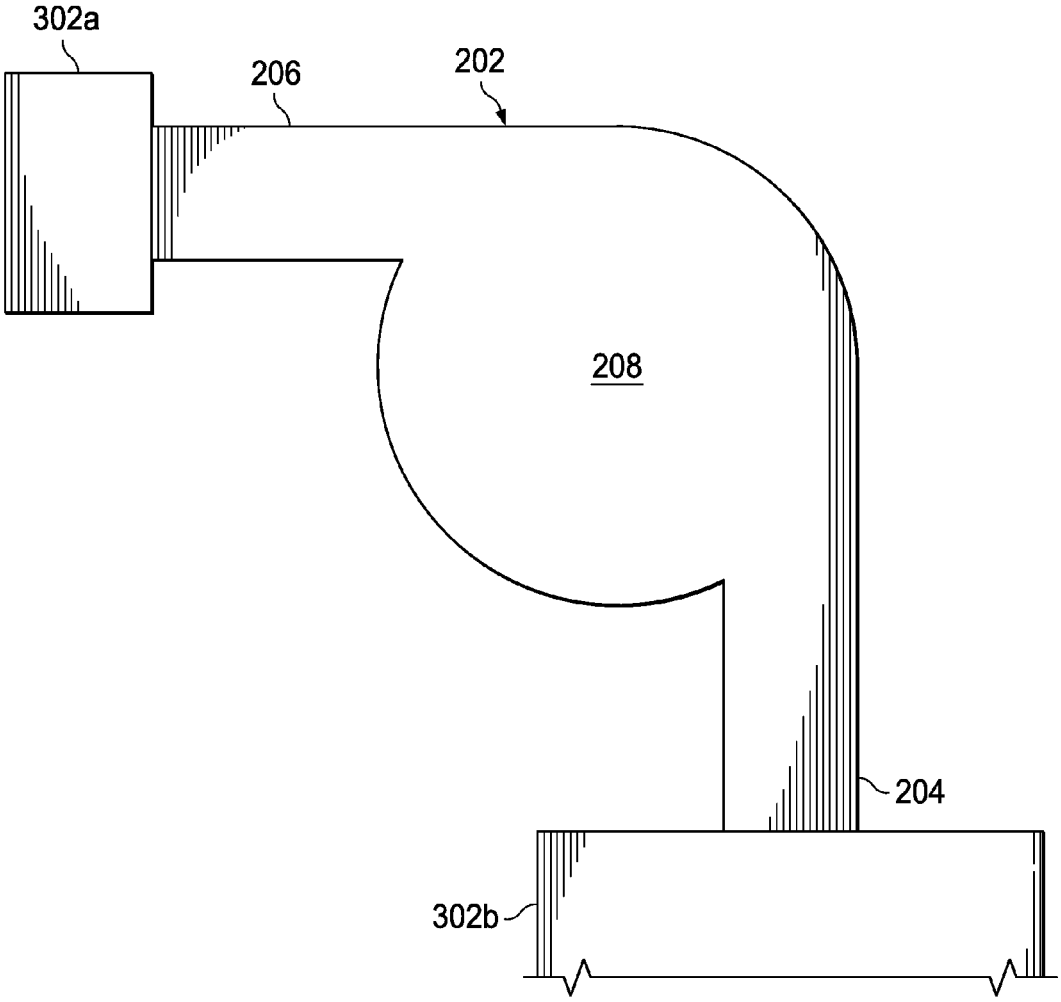
FIG. 3*b* is a side partial schematic view illustrating an embodiment of the pressurizing device of FIGS. 2*a*, 2*b* and 2*c* coupling a printing material storage to a print head.
Figure 3C:
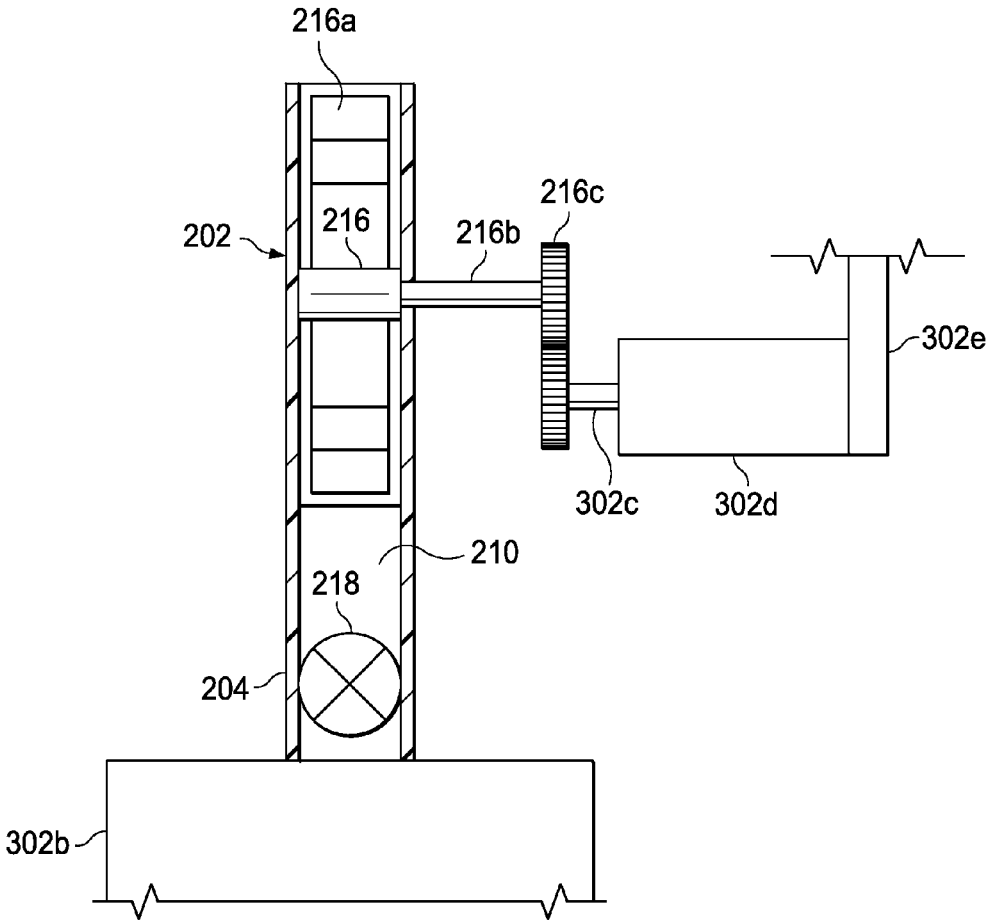
FIG. 3*c* is a rear partial schematic view illustrating an embodiment of the pressurizing device of FIGS. 2*a*, 2*b* and 2*c* coupling a printing material storage to a print head and engaging a motor.

Referring now to FIGS. 3*a*, 3*b* and 3*c*, a method 300 for delivering a printing material is illustrated. The method 300 begins at block 302 where a printing material storage coupled to a print head by a pressurizing device is provided. A print head 302*a* is provided that may include one or more print head nozzles as is known in the art. A printing material storage 302*b* that includes a printing material (e.g., ink and/or other printing materials known in the art) is also provided. In an embodiment, the print head 302*a* and the printing material storage 302*b* are coupled to the printer 118, described above with reference to FIG. 1, in a variety of manners known in the art. A PMDS is provided by coupling the pressurizing device 200, described above with reference to FIGS. 2*a*, 2*b* and 2*c*, to each of the print head 302*a* and the printing material storage 302*b*, with the storage coupling section 204 on the pressurizing device 200 coupled to the printing material storage 302*b* using methods known in the art (e.g., one or more conduits (e.g., tubing) coupled to both the printing material storage 302*b* and the inlet 212) such that the printing material in the printing material storage 302*b* is provided a passageway from the printing material storage 302*b* to the inlet 212, and with the print head coupling section 206 on the pressurizing device 200 coupled to the print head 302*a* using methods known in the art (e.g., one or more conduits (e.g., tubing) coupled to both the print head 302*a* and the outlet 214) such that printing material in the housing 210 is provided a passageway from the outlet 214 to the print head 302*a*, as illustrated in FIG. 3*b*. In an embodiment, the pressurizing device 200 is an off-axis pump that is operable to transfer the printing material from the printing material storage 302*b* to the print head 302*a*. With the pressurizing device 200 coupled to the print head 302*a* and the printing material storage 302*b*, the gear 216*c* that is located on the shaft 216*b* that extends from the rotatable member 216 may engage a motor gear 302*c* that extends from a motor 302*d* that is coupled to a clutch 302*e*. In an embodiment, the motor gear 302*c*, motor 302*d*, and clutch 302*e* are located in the printer 118, described above with reference to FIG. 1. In the illustrated embodiment, the clutch 302*e* has been illustrated as directly connected to the motor 302*d* in order to simplify the description. However, one of skill in the art will recognize that the clutch 302*e* may be connected to a variety of the components of the PMDS in order to engage and disengage the motor gear 302*c* and the gear 216*c*, described in further detail below, without departing from the scope of the present disclosure. In an embodiment, the motor 302*d* may be an independent motor that is dedicated to powering the rotatable member 216. In an embodiment, the independent motor dedicated to powering the rotatable member 216 may have its speed variably controlled by a controller (e.g., firmware) independent of other motors in the printer 118. In an embodiment, the motor 302*d* may be an existing motor in the printer 118 that is used for other purposes such as, for example, moving the print head adjacent the printing media, feeding the printing media into the printer 118, and/or a variety of other existing printer motors known in the art.

Figure 3D:
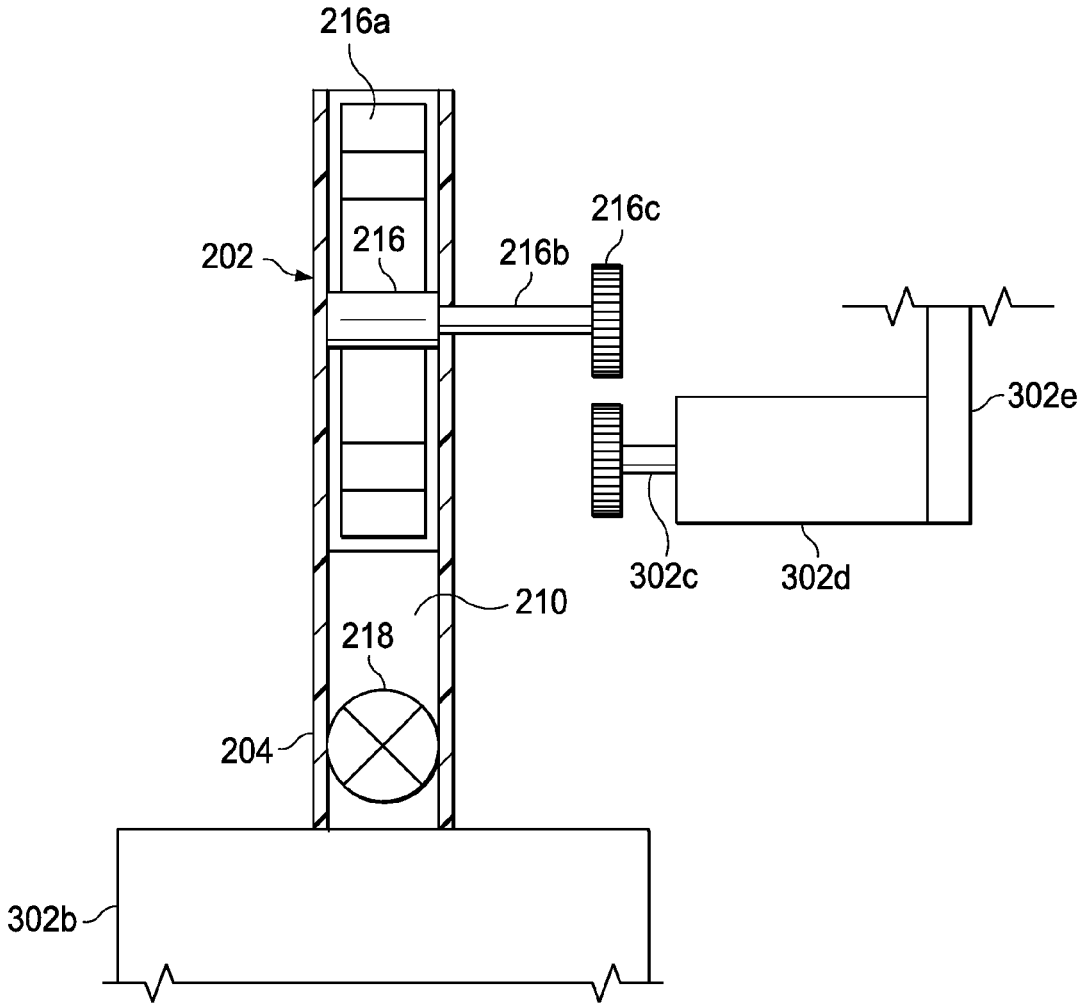
FIG. 3*d* is a rear partial schematic view illustrating an embodiment of the pressurizing device of FIGS. 2*a*, 2*b* and 2*c* coupling a printing material storage to a print head and disengaging a motor.

The method 300 then proceeds to block 304 where the rotatable member in the pressurizing device is rotated to create a pressure differential. The clutch 302*e* may be activated to engage (see FIG. 3*c*) and disengage (see FIG. 3*d*) the motor gear 302*c* and the gear 216*c* that is coupled to the rotatable member 216 through the shaft 216*b*. When the clutch 302*e* is activated to engage the motor gear 302*c* with the gear 216*c* and the motor 302*d* is activated, the motor 302*d* rotates the motor gear 302*c*, which in turn rotates the shaft 216*b*, which in turn rotates the rotatable member 216. In an embodiment, the motor of the printer 118 that moves the print head adjacent the printing media or the motor that feeds the printing media into the printer 118 may be engaged by the clutch 302*e*. Other gears or components may also be utilized to rotate the rotatable member 216 at a rate proportional to the speed of the motor. In another embodiment, the clutch 302*e* may be removed from the PMDS, and a variable speed independent motor may include the motor gear 302*c* engaged with the gear 216*c* to rotate the rotatable member 216. The rotation of the rotatable member 216 in the housing 210 moves the rotatable member blades 216*a* through the housing 210 and creates a pressure differential in the housing 210. In an embodiment, the pressure differential created by the rotation of the rotatable member 216 creates a pressure in the housing 210 that is greater than the pressure outside the pressurizing device 200. The method 300 then proceeds to block 306 where the pressure in the pressurizing device 200 is monitored. The pressure monitor 222 monitors the pressure in the housing 210 and may transfer that data to, for example, the processor 102, described above with reference to FIG. 1, and/or other IHS components. In an embodiment, the processor 102 and/or other IHSs components that may also be coupled to the clutch 302*e*, and the data from the pressure monitor 222 may be used to activate the clutch 302*e* to engage and/or disengage the motor gear 302*c* and the gear 216*c* to control the pressure in the housing 210. For example, the clutch 302*e* may be activated to engage the motor gear 302*c* and the gear 216*c* when the motor 302*d* is rotating the motor gear 302*c* in order to rotate the rotatable member 216. The rotatable member 216 will rotate and create a pressure in the housing 210 that may increase as the rotatable member 216 continues to rotate. That pressure created by the rotatable member 216 will be monitored by the pressure monitor 222, and once the pressure monitored by the pressure monitor 222 exceeds a predetermined level, that pressure may be detected by a controller that can then activate the clutch 302*e* to disengage the motor gear 302*c* and the gear 216*c*. Disengagement of the motor gear 302*c* and the gear 216*c* stops the driving of the rotatable member 216 and will result in a reduction of the pressure in the housing 210. In another embodiment, the clutch 302*e* may be removed from the PMDS, and a variable speed independent motor that includes the motor gear 302*c* engaged with the gear 216*c* to rotate the rotatable member 216 may be driven at variable speeds that maintain the pressure in the housing 210 at a desired level. Thus, the pressure in the housing 210 may be controlled and/or maintained at a desired level.

The method 300 then proceeds to block 308 where the printing material is transferred from the printing material storage, through the pressurizing device, and out of the print head. The pressure differential created by the rotation of the rotatable member 216 in block 304 of the method 300 transfers the printing material from the printing material storage 302*b*, through any conduits to the inlet 212, through the check valve 218, through the housing 210, through the release valve 220 through the outlet 214, through any conduits to the print head 302*a*, and then and out of the print head 302*a* onto any media a user of the PMDS desires. In an embodiment, the check valve 218 operates to prevent the backflow of the printing material into the printing material storage 302*b*. For example, the check valve 218 may include a single direction open/close valve that may be activated electrically or mechanically to stop the flow of the printing material out of the inlet 212 for servicing purposes, when the pressure in the housing 210 exceeds a predetermined level, and/or for a variety of other purposes known in the art. In an embodiment, the release valve 220 operates to release air from the housing 210 on startup rotation of the rotatable member 216. The PMDS described above allows a pressure to be created in the housing 210 that ensures the delivery of the printing material from the printing material storage 302*b* to the print head 302*a* during high speed printing, which will allow printers such as, for example, inkjet printers, to print at much higher speeds relative to conventional inkjet printers.

Figure 4A:
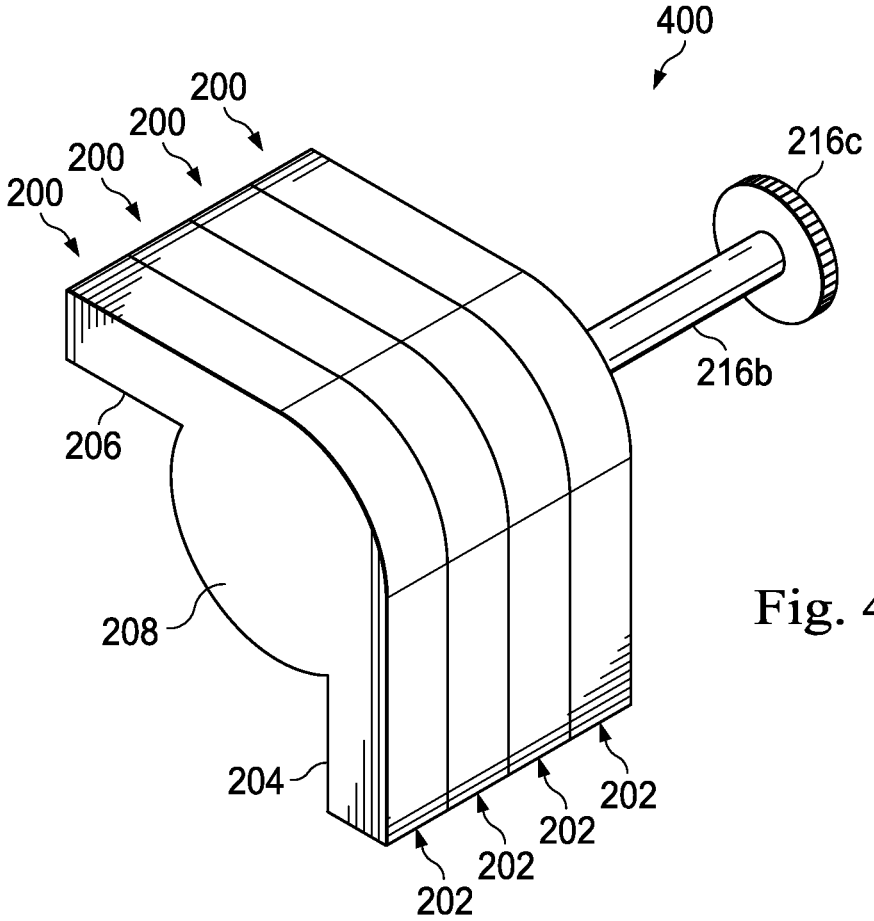
FIG. 4*a* is a perspective view illustrating an embodiment of a pressurizing device.

Referring now to FIG. 4*a*, a pressurizing device 400 is illustrated that includes a plurality of the pressurizing devices 200 that are substantially the same in structure and operation as described above with reference to FIGS. 2*a*, 2*b*, 2*c*, 3*a*, 3*b*, 3*c* and 3*d*, with the provision that each of the rotatable members 216 in the plurality of pressurizing devices 200 are coupled to the shaft 216*b*. In an embodiment, each of the rotatable members 216 may be directly coupled to the shaft 216*b*. In another embodiment, each of the rotatable members 216 may include a clutch device that is operable to engage and/or disengage the shaft 216*b* in order to allow rotatable members 216 in different pressurizing devices 200 to be rotated through their engagement with the shaft 216*b* at different times.

Figure 4B:
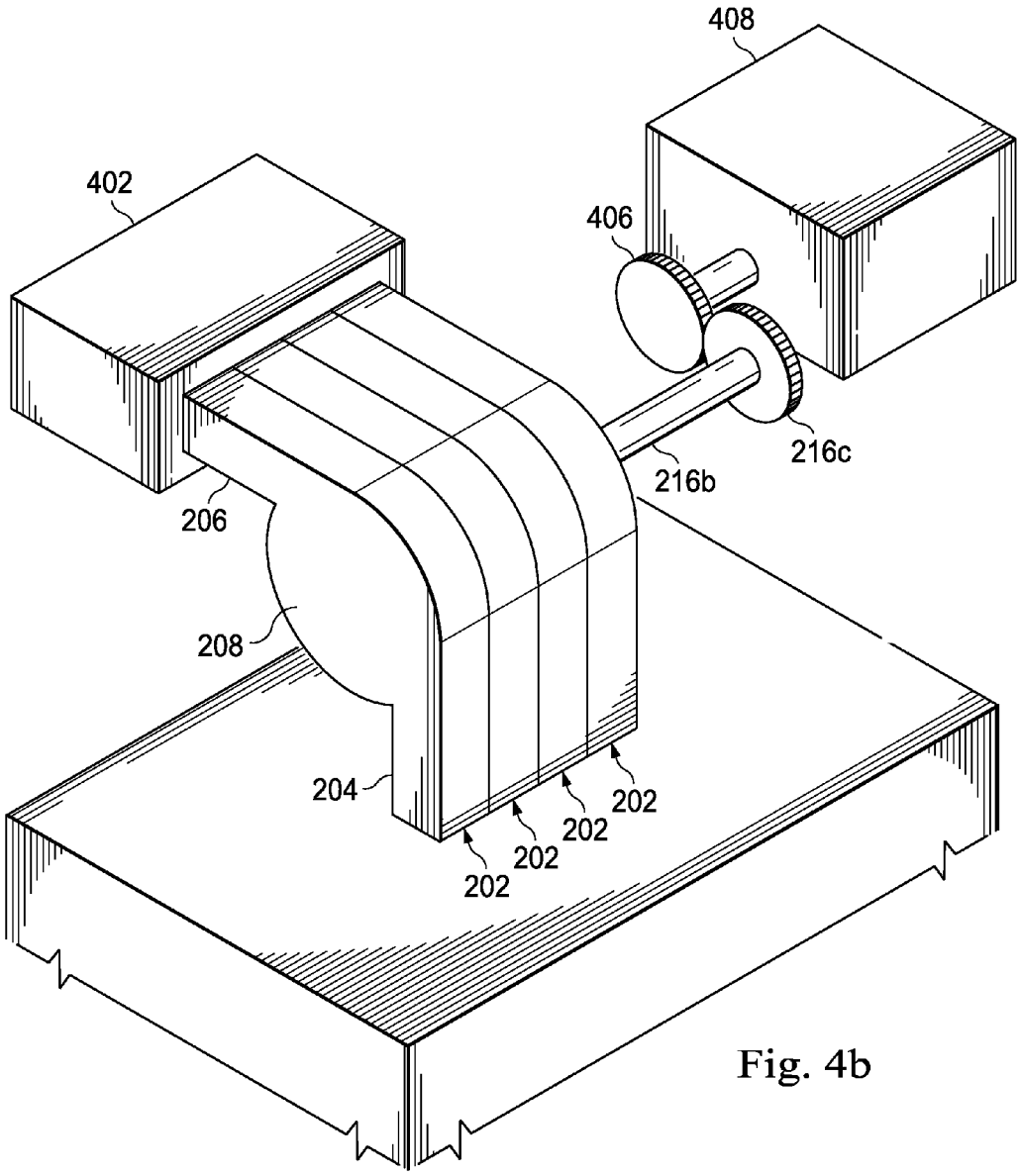
FIG. 4*b* is a perspective partial schematic view illustrating an embodiment of the pressurizing device of FIG. 4*a* coupling a printing material storage to a print head and engaging a motor.

Referring now to FIG. 4*b*, the pressurizing device 400 may operate according to the method 300 in substantially the same manner as described above for the pressurizing device 200, with the exception of a modified block 302. At block 302, a print head 402 is provided that includes one or more print head components each having one or more nozzles as is known in the art. A printing material storage 404 includes a plurality of printing material storage compartments that each include a printing material (e.g., ink and/or other printing materials known in the art) that is of a different color from the printing material in the other printing material storage compartments. In an embodiment, each printing material storage compartment is associated with a particular print head component such that a particular color printing material from a particular printing material storage compartment is transferred to a particular print head component. In an embodiment, the print head 402 and the printing material storage 404 are coupled to the printer 118, described above with reference to FIG. 1, as is known in the art. The pressurizing device 400 is coupled to each of the print head 402 and the printing material storage 404, with each of the storage coupling sections 204 on the pressurizing device 400 coupled to a different printing material storage compartment in the printing material storage 404 using methods known in the art (e.g., one or more conduits (e.g., tubing) coupled to both the printing material storage 404 and the inlets 212) such that the printing material in each printing material storage compartment is provided a passageway from that printing material storage compartment to the inlet 212, and with each of the print head coupling sections 206 on the pressurizing device 400 coupled to a respective print head components on the print head 402 using methods known in the art (e.g., one or more conduits (e.g., tubes) coupled to both the print head 402 and the outlets 214) such that printing material in each housing 210 is provided a passageway from the housing 210 to the respective print head component, as illustrated in FIG. 4*b*. In an embodiment, the pressurizing device 400 is an off-axis pump that is operable to transfer the printing material from the printing material storage compartments in the printing material storage 404 to the print head components in the print head 402. With the pressurizing device 400 coupled to the print head 402 and the printing material storage 404, the gear 216*c* that is located on the shaft 216*b* that extends from the rotatable member 216 engages a motor gear 406 on a motor 408. The method 300 may then proceed to block 304 where the rotatable members 216 in the pressurizing device 400 are rotated to create a pressure differential, block 306 where the pressure in the pressurizing device 400 is monitored, and block 308 where printing material in the printing material storage compartments is transferred to the print head components substantially as described above.

Although illustrative embodiments have been shown and described, a wide range of modification, change and substitution is contemplated in the foregoing disclosure and in some instances, some features of the embodiments may be employed without a corresponding use of other features. Accordingly, it is appropriate that the appended claims be construed broadly and in a manner consistent with the scope of the embodiments disclosed herein.

What is claimed is:

1. A printing material delivery system, comprising:

a printing material storage that comprises a printing material;

a print head;

a pressurizing device defining a housing that comprises an inlet coupled to the printing material storage, an outlet coupled to the print head, and that houses a rotatable member that is operable to rotate and create a substantially constant pressure differential in the housing during printing operations in order to transfer the printing material from the printing material storage, through the pressurizing device, and out of the print head; and a pressure monitor located in the housing, wherein data from the pressure monitor is provided for controlling the pressurizing device in order to maintain the substantially constant pressure differential in the housing during printing operations.

2. The system of claim 1, further comprising:

a release valve located between the rotatable member and the outlet.

3. The system of claim 1, further comprising:

a check valve located between the rotatable member and the inlet.

4. The system of claim 1, wherein the printing operations includes high speed printing operations of approximately 100 pages per minute.

5. The system of claim 1, further comprising:

a motor coupled to the rotatable member.

6. The system of claim 5, further comprising:

a clutch mechanism that is coupled to the motor and the rotatable member and operable to disengage the motor from the rotatable member.

7. The system of claim 1, wherein the printing material storage comprises a plurality of printing material storage compartments, the print head comprises a plurality of print head components, and wherein printing material storage compartments and print head component pairs correspond to a particular color printing material that is stored in a particular printing material storage compartment and transferred to the corresponding print head component.

8. The system of claim 7, wherein the pressurizing device comprises a plurality of pressurizing devices, and wherein each pressurizing device defines a housing that comprises an inlet coupled to a printing material storage compartment that stores a particular color printing material, an outlet coupled to the print head component that corresponds to the particular color printing material, and that houses a rotatable member that is operable to rotate and create a substantially constant pressure differential in the housing during printing operations in order to transfer the particular color printing material from the printing material storage compartment, through the pressurizing device, and out of the print head component, and wherein a pressure monitor is located in each housing and data from each pressure monitor is provided for maintaining the substantially constant pressure differential in that housing during printing operations.

9. An information handling system, comprising:

a processor;

a memory coupled to the processor; and a printer coupled to the processor, the printer comprising:

a printing material storage that comprises a printing material;

a print head;

a pressurizing device defining a housing that comprises an inlet coupled to the printing material storage, an outlet coupled to the print head, and that houses a rotatable member that is operable to rotate and create a constant pressure differential in the housing during printing operations in order to transfer the printing material from the printing material storage, through the pressurizing device, and out of the print head; and a pressure monitor located in the housing, wherein data from the pressure monitor is provided for maintaining the constant pressure differential in the housing.

10. The system of claim 9, further comprising:

a release valve located between the rotatable member and the outlet.

11. The system of claim 9, further comprising:

a check valve located between the rotatable member and the inlet.

12. The system of claim 9, wherein the printing operations includes high speed printing operations of at least 100 pages per minute.

13. The system of claim 9, further comprising:

a motor coupled to the rotatable member.

14. The system of claim 13, further comprising:

a clutch mechanism that is coupled to the motor and the rotatable member and operable to disengage the motor from the rotatable member.

15. The system of claim 9, wherein the printing material storage comprises a plurality of printing material storage compartments, the print head comprises a plurality of print head components, and wherein printing material storage compartments and print head component pairs correspond to a particular color printing material that is stored in a particular printing material storage compartment and transferred to the corresponding print head component.

16. The system of claim 15, wherein the pressurizing device comprises a plurality of pressurizing devices, and wherein each pressurizing device defines a housing that comprises an inlet coupled to a printing material storage compartment that stores a particular color printing material, an outlet coupled to the print head component that corresponds to the particular color printing material, and that houses a rotatable member that is operable to rotate and create a constant pressure differential in the housing during printing operations in order to transfer the particular color printing material from the printing material storage compartment, through the pressurizing device, and out of the print head component, and wherein a pressure monitor is located in each housing and data from each pressure monitor is provided for maintaining the constant pressure differential in that housing during printing operations.

17. A method for delivering a printing material, comprising:

providing a printing material storage coupled to a print head by a pressurizing device;

rotating a rotatable member that is located in the pressurizing device in order to create a substantially constant pressure differential in a pressure device housing during printing operations;

using the pressure differential to transfer a printing material that is located in the printing material storage from the printing material storage, through the pressurizing device, and out of the print head; and monitoring the pressure in the pressure device housing to maintain the substantially constant pressure differential in the pressure device housing during printing operations.

18. The method of claim 17, wherein the rotating the rotatable member comprises engaging a motor and the rotatable member using a clutch.

19. The method of claim 17, wherein the printing operations includes high speed printing operations of at least 100 pages per minute.

20. The method of claim 17, further comprising:

preventing printing material from moving from the pressurizing device to the printing material storage using a check valve.

* * * * *